US008947345B2

(12) United States Patent
Yamada

(10) Patent No.: US 8,947,345 B2
(45) Date of Patent: Feb. 3, 2015

(54) DISPLAY DEVICE, AND CONTROLLER

(75) Inventor: Yusuke Yamada, Shiojiri (JP)

(73) Assignee: Seiko Epson Corporation (JP)

( * ) Notice: Subject to any disclaimer, the term of this patent is extended or adjusted under 35 U.S.C. 154(b) by 317 days.

(21) Appl. No.: 13/010,080

(22) Filed: Jan. 20, 2011

(65) Prior Publication Data

US 2011/0187766 A1 Aug. 4, 2011

(30) Foreign Application Priority Data

Feb. 1, 2010 (JP) ..... 2010-020509

(51) Int. Cl.
*G09G 3/34* (2006.01)
*G09G 5/00* (2006.01)

(52) U.S. Cl.
CPC . *G09G 5/00* (2013.01); *G09G 3/344* (2013.01)
USPC ..... 345/107

(58) Field of Classification Search
USPC ..... 345/698
See application file for complete search history.

(56) References Cited

U.S. PATENT DOCUMENTS

| | | | | |
|---|---|---|---|---|
| 8,174,754 | B2 * | 5/2012 | Lee et al. | 359/296 |
| 2002/0036616 | A1 | 3/2002 | Inoue | |
| 2006/0187185 | A1 | 8/2006 | Yoshinaga et al. | |
| 2008/0278436 | A1 * | 11/2008 | Sato | 345/107 |
| 2008/0309674 | A1 * | 12/2008 | Barrus et al. | 345/545 |

FOREIGN PATENT DOCUMENTS

| | | |
|---|---|---|
| CN | 101727836 A | 6/2010 |
| JP | 2005-025163 | 1/2005 |
| WO | 01-91096 | 11/2001 |

* cited by examiner

*Primary Examiner* — Joseph Haley
(74) *Attorney, Agent, or Firm* — Harness, Dickey & Pierce, P.L.C.

(57) ABSTRACT

A display device including a display unit having a plurality of pixels includes a calculation unit which accumulates the number of pixels of which display state is changed among the plurality of pixels so as to calculate the accumulated number of update pixels when a part of an image displayed on the display unit is changed, and a refresh control unit which executes a refresh operation of the display unit when the calculated accumulated number of update pixels becomes equal to or more than a defined value.

8 Claims, 7 Drawing Sheets

DISPLAY DEVICE, AND CONTROLLER

BACKGROUND

1. Technical Field

The present invention relates to a display device such as an electrophoretic display device, for example.

2. Related Art

As a display device of this type, electrophoretic display devices used for electronic books or the like are disclosed in JP-A-2005-25163 and International Publication No. 2001/091096, for example. In JP-A-2005-25163, an image input by hand (by a pen) is overwritten onto a normal image (an image input by other than a pen) so that a display image is rewritten. To be more specific, when a normal image is displayed, after entire white display is performed by reset-driving, an image is written by writing-driving. On the other hand, when an image is input by hand, only writing-driving is performed without reset-driving. In the latter case, partial writing is performed on pixels included in a pen input region such that the pixels display a darkest state (black) (for example, second embodiment).

If such partial rewriting is repeatedly performed, afterimages are accumulated. This causes a risk that a display image is disturbed. International Publication No. 2001/091096 discloses a technique of executing a refresh operation every time a predetermined period of time passes in order to prevent deterioration in image quality due to image disturbance. It is to be noted that in a display device, the refresh operation may be performed every time rewriting is performed a predetermined number of times in addition to or instead of every predetermined time depending on cases.

However, in International Publication No. 2001/091096, a trouble that an image disturbed due to partial rewriting is visually recognized by a user who uses an electronic book or the like for a relatively long period of time until a predetermined period of time passes is caused. Further, a following trouble is also caused. That is, even in a case where partial slight disturbance is caused on a display image in a screen due to partial rewriting, a refresh operation (or reset-driving) is automatically performed on the entire screen. Therefore, a cancellation screen with the entire black or white display is visually recognized by a user frequently and thus user's convenience is impaired.

In order to solve the problems, it can be considered that pixels located only in a region on which partial rewriting has been performed every partial rewriting in a screen are subjected to reset-driving. In this case, a difference in contrast is caused between a region on which reset-driving has been performed and other regions due to a difference in an elapsed time since writing has been performed or the like. In addition, there arises a problem that partial rewriting is delayed because of the reset-driving.

SUMMARY

An advantage of some aspects of the invention is to provide a display device which can appropriately perform a refresh operation, improve image quality, and improve convenience for a user.

According to an aspect of the invention, a display device including a display unit having a plurality of pixels includes a calculation unit which accumulates the number of pixels of which display state is changed among the plurality of pixels so as to calculate the accumulated number of update pixels when a part of an image displayed on the display unit is changed, and a refresh control unit which executes a refresh operation of the display unit when the calculated accumulated number of update pixels becomes equal to or more than a defined value.

The display device according to the aspect of the invention is typically configured as an electrophoretic display device. In this case, an electrophoretic element is driven on each of the plurality of pixels so that an image is displayed on the display unit. It is to be noted that a display device according to the aspect of the invention is not limited to the above-described electrophoretic type and may be an electronic liquid power type or the like.

A part of a plurality of pixels is partially rewritten on the display unit so that a part of a displayed image is changed. In this case, the display states are changed on pixels on which rewriting is required to be performed. To be more specific, the display state is changed from the first gradation (for example, white) to the second gradation (for example, black), or from the second gradation (for example, black) to the first gradation (for example, white) on such pixels. The partial rewriting performed by changing display states on a part of the plurality of pixels in such a manner is explained as "partial rewriting" in some case, hereinafter.

The display device according to the aspect of the invention includes a calculation unit and a refresh control unit. When a part of an image displayed is changed by the partial rewriting, the calculation unit accumulates pixels of which display state is changed among the plurality of pixels so as to calculate the accumulated number of update pixels. The accumulated number of update pixels is preferably calculated in the following manner. The calculation unit typically calculates an Exclusive OR between an image before changed and an image after changed so as to judge pixels of which display state is changed from the plurality of pixels. Then, the calculation unit counts the bits so as to obtain the number of pixels of which display state is changed. Subsequently, the calculation unit accumulates the number of pixels of which display state is changed to a total number of pixels of which display state is changed so as to calculate the accumulated number of update pixels. At this time, the number of pixels of which display state is changed is the number of pixels obtained when the image after changed is displayed. Further, the total number of pixels of which display state is changed is the total number of pixels obtained every partial rewriting before the image after changed is displayed and since a just previous refresh operation has been performed.

The refresh control unit judges whether the accumulated number of update pixels which has been calculated by the calculation unit is equal to or more than a defined value. If the accumulated number of update pixels is equal to or more than the defined value, the refresh control unit executes a refresh operation of the display unit. It is preferable that the refresh operation be performed by driving each of the plurality of pixels on the display unit to display the same gradation (for example, white or black). When such refresh operation is performed, a cancellation screen with the entire white or black display is typically displayed on the display unit.

Accordingly, in the display device according to the aspect of the invention, image disturbance caused due to accumulation of afterimages by the partial rewriting or the like can be prevented from being significantly caused on the display unit. The refresh operation is performed by the judgment whether the accumulated number of update pixels is equal to or more than the defined value regardless of a predetermined period of time or a predetermined number of times of rewritings. Therefore, in a case where a display content is largely changed and the number of pixels of which display state is changed becomes a relatively large value, the refresh operation can be executed in a relatively short time after the partial rewriting has been performed. Accordingly, a disturbed image can be prevented from being visually recognized by a user for a relatively long period of time. It is to be noted that in the display device according to the aspect of the invention, the refresh operation may be performed every time a predetermined period of time passes or every time the partial rewriting is performed a predetermined number of times.

Frequency of the refresh operation is defined by the defined value in the refresh control unit. Therefore, the refresh operation can be performed appropriately depending on the degree of image disturbance caused due to partial rewriting. Accordingly, a trouble that the refresh operation is performed with slight partial image disturbance and thus a cancellation screen with entire white or black display is visually recognized by a user frequently can be suppressed.

Accordingly, with the above-described display device according to the aspect of the invention, the refresh operation can be appropriately performed as described above, the image quality can be improved and the convenience for a user can be improved.

In the display device according to the aspect of the invention, it is preferable that the calculation unit weigh the number of pixels in accordance with the number of times that the display state is changed so as to calculate the accumulated number of update pixels in each of a plurality of partial regions formed by dividing the display unit.

According to the aspect of the invention, the display unit is divided into a plurality of partial regions and the calculation unit accumulates the number of pixels of which display state is changed by the partial rewriting so as to calculate the accumulated number of update pixels for each of the partial regions. The calculation unit weighs and accumulates the number of pixels of which display state is changed. At this time, the calculation unit weighs the number of pixels of which display state is changed in accordance with the number of times that the display state has been changed, that is, the number of times of partial rewritings since a just previous refresh operation has been performed. The refresh control unit judges whether the accumulated number of update pixels calculated for each of the partial regions is equal to or more than a defined value.

There is a risk that image disturbance is accumulated and becomes significant on pixels located in a partial region on which partial rewriting is repeatedly performed and the number of times of partial rewritings is relatively large among the plurality of partial regions. In such a partial region, weight in accordance with the number of times of partial rewritings becomes relatively large. Therefore, the accumulated number of update pixels reaches to the defined value and the refresh operation can be performed before image disturbance becomes significant and more deteriorated.

In the display device according to the aspect of the invention in which the number of pixels of which display state is changed is weighed to calculate the accumulated number of update pixels in each of the plurality of partial regions, it is preferable that each of the plurality of partial regions correspond to each of the pixels.

With the configuration, each of the plurality of partial regions corresponds to each region which each of the plurality of pixels occupies on the display unit. Accordingly, the refresh operation can be performed on pixels on which partial rewriting is repeatedly performed and the number of times of partial rewritings is relatively large among the plurality of pixels before the image disturbance is more deteriorated.

In the display device according to another aspect of the invention, it is preferable that the calculation unit accumulate the number of pixels so as to calculate the accumulated number of update pixels in each of a plurality of partial regions formed by dividing the display unit.

According to the aspect of the invention, the display unit is divided into a plurality of partial regions and the calculation unit accumulates the number of pixels of which display state is changed by partial rewriting so as to calculate the accumulated number of update pixels for each of the partial regions. The refresh control unit judges whether the accumulated number of update pixels calculated for each of the partial regions is equal to or more than the defined value. It is preferable that the refresh operation be partially performed on a partial region on which the accumulated number of update pixels reaches to a defined value. At this time, each of the pixels located in the partial region is driven to display the same gradation (for example, white or black). It is to be noted that with such a partial refresh operation, since frequency of the refresh operation is different among the pixels, difference in quality of displayed image such as contrast is caused among the pixels as in the partial reset-driving which has been already described. Accordingly, in order to prevent such a problem from being caused, the refresh operation may be performed on the entire screen typically with the entire white or black display.

Therefore, in the aspect of the invention, the accumulated number of update pixels is obtained for each of the partial regions and the above-described partial refresh operation is performed, thereby smoothly performing a refresh operation for a short period of time. This makes it possible to reduce the user's irritation and improve the convenience.

In the display device according to still another aspect of the invention, it is preferable that the refresh control unit execute the refresh operation every time a predetermined period of time passes or in accordance with a predetermined number of times that a part of the image is changed.

According to the aspect of the invention, the refresh operation can be performed every time a predetermined period of time passes or every time a part of the image is changed a predetermined number of times. Accordingly, image disturbance caused due to accumulation of afterimages by the partial rewriting or the like can be prevented more reliably from being significantly caused on the display unit.

Effects and other advantages of the aspects of the invention will be obvious from modes for carrying out the invention, which will be described below.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to drawings.

At first, a configuration of a display device according to the embodiment is described with reference to FIG. 1.

Figure 1:
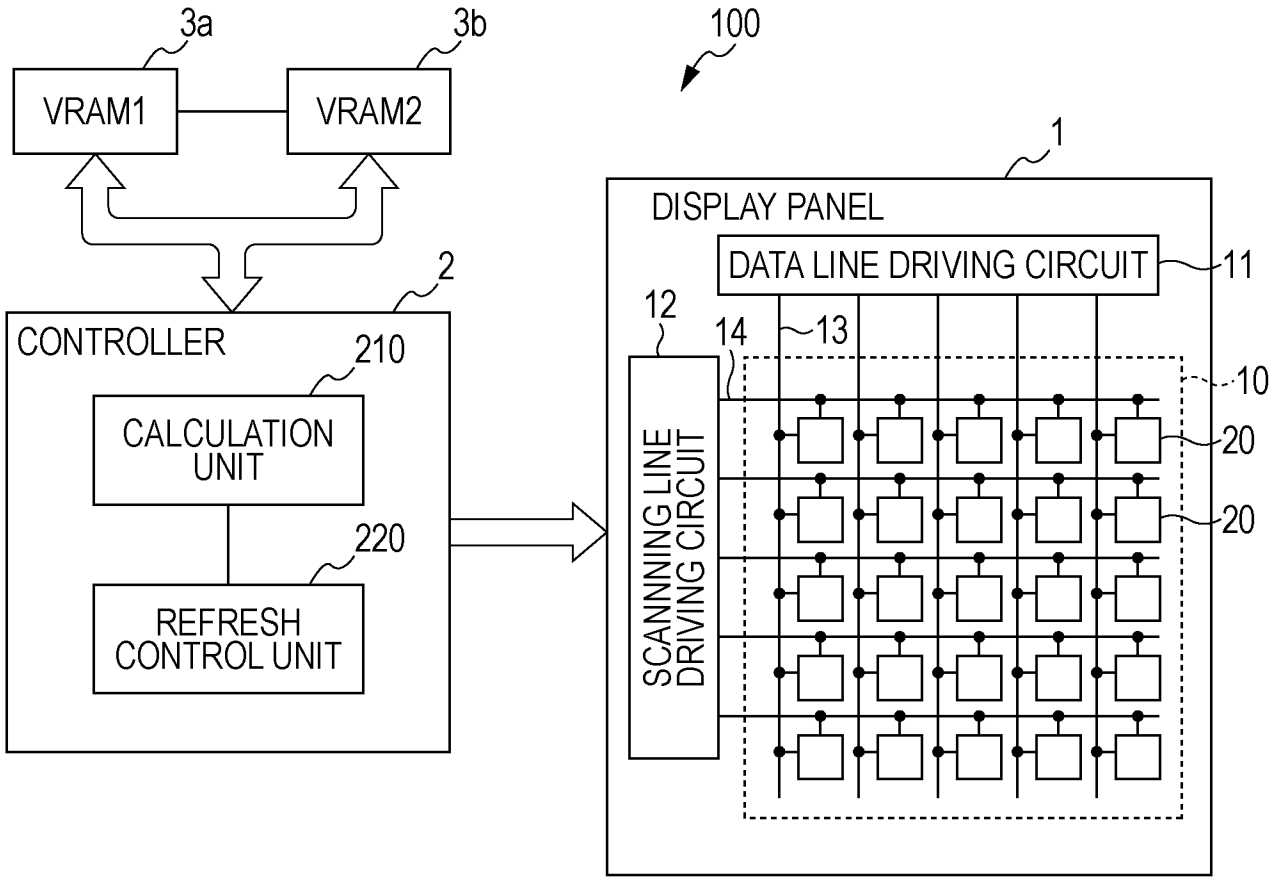
FIG. 1 is a block diagram schematically illustrating an example of a configuration of a display device according to the embodiment.

FIG. 1 is a block diagram schematically illustrating an example of a configuration of the display device according to the embodiment.

In FIG. 1, a display panel 1, a controller 2, a VRAM 13*a* and a VRAM 23*b* are included in the main part of a display device 100 according to the embodiment. Although not shown in FIG. 1, a CPU (Central Processing Unit), a RAM (Random Access Memory), a ROM (Read Only Memory) or the like is provided in the display device 100.

The display device 100 is typically configured as an electrophoretic display device. On the display panel 1, a plurality of pixels 20 are arranged on a display unit 10. A plurality of data lines 13 and scanning lines 14 are wired on the display unit 10 so as to intersect with each other, for example. The plurality of pixels 20 are arranged in a matrix form so as to correspond to the intersections of the data lines 13 and the scanning lines 14. The plurality of data lines 13 are driven by a data line driving circuit 11 and the plurality of scanning lines 14 are driven by a scanning line driving circuit 12.

In this case, each pixel 20 is electrically connected to the data line 13 and the scanning line 14 so as to be driven. Therefore, for example, an electrophoretic element is driven on each pixel 20 so that an image is displayed on the display unit 10. It is to be noted that a detail configuration of each pixel 20 is not shown in the drawing.

The controller 2 is configured to be accessible to each of the VRAM 13*a* and the VRAM 23*b*. A calculation unit 210 and a refresh control unit 220 are included in the main part of the controller 2. As will be described later, when a part of an image displayed on the display unit 10 is changed, the calculation unit 210 calculates the accumulated number of update pixels and the refresh control unit 220 executes a refresh operation when the calculated accumulated number of update pixels becomes equal to or higher than a defined value.

Next, each embodiment relating to the above-described display device is described with reference to the following drawings in addition to FIG. 1.

First Embodiment

Figure 2:
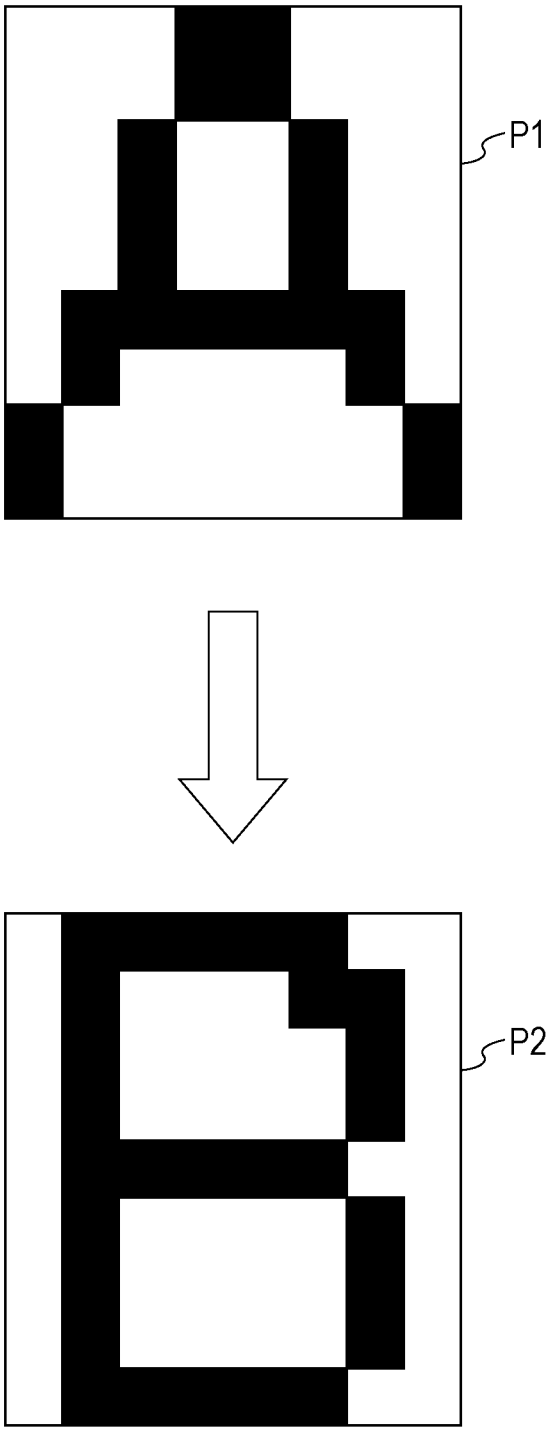
FIG. 2 is a view simply illustrating an example of an image before changed and an image after changed when a part of an image displayed on a display unit is changed.

At first, a first embodiment is described with reference to FIG. 2 through FIG. 4. FIG. 2 is a view simply illustrating an example of an image before changed and an image after changed when a part of an image displayed on a display unit is changed.

In FIG. 2, in the embodiment, a part of an image P1 displayed on the display unit 10 as illustrated in FIG. 1 is changed and the image P1 is rewritten to an image P2 after changed. In the image P1, a black character "A" is drawn on white background. In the image P2, a black character "B" is drawn on white background.

Figure 3:
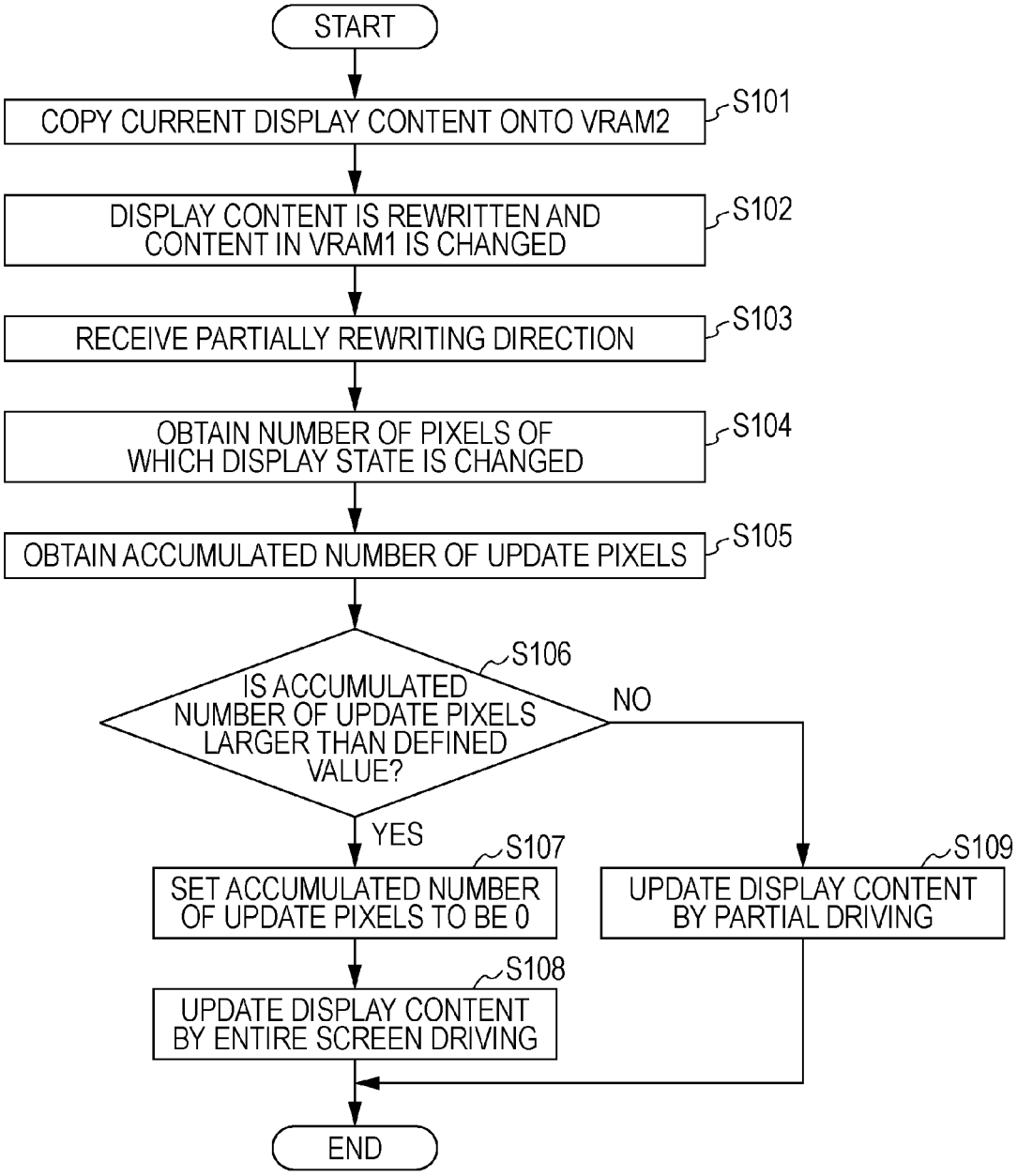
FIG. 3 is a flowchart for explaining a series of processing performed in the display device according to the first embodiment.

FIG. 3 is a flowchart for explaining a series of processing performed in the display device according to the embodiment.

In FIG. 3, the controller 2 accesses to the VRAM 23*b* and copies information indicating a display content of the image P1 before changed, which is being displayed on the display unit 10 (step S101). Subsequently, the controller 2 accesses to the VRAM 13*a* and rewrites the information in the VRAM 13*a* to information indicating a display content of the image P2 after changed (step S102). It is to be noted that information indicating the display content of the image P1 or the image P2 is based on the information which has been previously stored in a RAM or a ROM, for example.

An image displayed on the display unit 10 is changed by entirely or partially rewriting data on the plurality of pixels 20. The controller 2 receives a partial rewriting direction to partially rewrite data on the pixels from a CPU (step S103).

Thereafter, the calculation unit 210 in the controller 2 typically calculates an Exclusive OR between the image P1 before changed and the image P2 after changed so as to judge pixels of which display state is changed from the plurality of pixels 20. Then, the calculation unit 210 counts the bits so as to obtain the number of pixels of which display state is changed (step S104).

Figure 4:
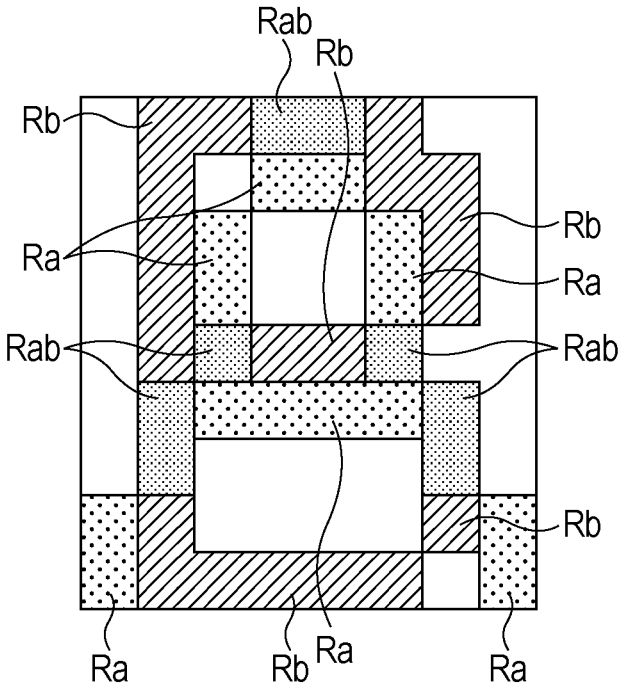
FIG. 4 is a view illustrating different portions and common portions between characters in an image "P1" before changed and an image "P2" after changed.

FIG. 4 is a view illustrating different portions and common portions between characters in the image P1 before changed and the image P2 after changed. The image P1 before changed and the image P2 after changed in FIG. 2 are compared with each other with focusing on each character. Then, portions forming not the character "B" but the character "A" correspond to character portions Ra, portions forming not the character "A" but the character "B" correspond to character portions Rb and portions common to the character "A" and the character "B" correspond to character portions Rab.

Therefore, when the image P1 is changed to the image P2, a display state of each pixel displaying the character portion Ra is required to be changed from a second gradation (black) to a first gradation (white) and a display state of each pixel displaying the character portion Rb is required to be changed from the first gradation (white) to the second gradation (black). On the other hand, the display state of each pixel displaying the character portion Rab is kept to be second gradation (black) in such case.

In step S104, the calculation unit 210 calculates an Exclusive OR between the image P1 before changed and the image P2 after changed to identify pixels displaying the character portions Ra and Rb. Further, the calculation unit 210 counts the bits so as to obtain the number of these pixels.

To be preferable, the calculation unit 210 may be configured to have an arithmetic unit which calculates an Exclusive OR and a circuit which automatically counts and accumulates the bits in combination. Alternatively, the calculation unit 210 may be configured so as to perform processing in step S104 and subsequent step S105 based on a known algorithm by software.

Subsequently, the calculation unit 210 accumulates the number of pixels of which display state is changed, which has been obtained in step S104, so as to calculate the accumulated number of update pixels (step S105). To be more specific, before the image P2 after changed is displayed, the calculation unit 210 accumulates the number of pixels of which display state is changed every partial rewriting since a just previous refresh operation has been performed. That is, the calculation unit 210 accumulates the number of pixels of which display state is changed every partial rewriting until the image P1 before changed as a previous image with respect to the image P2 after changed, which is to be displayed currently, is displayed. Note that the previous refresh operation is a refresh operation adjacent to and just before the current refresh operation which is performed in accordance with the flows in FIG. 3 (processing in steps S107 and S108, which will be described later) on a time axis. Then, the calculation unit 210 accumulates the number of pixels of which display state is changed, which has been obtained in step S104, to a total number of pixels of which display state is changed, which has been obtained in the above manner. Thus, the calculation unit 210 obtains the accumulated number of update pixels.

Then, the refresh control unit 220 in the controller 2 judges whether the accumulated number of update pixels, which has been calculated in step S105, is equal to or more than a defined value (step S106). If the accumulated number of update pixels is equal to or more than the defined value (step S106; Yes), the refresh control unit 220 executes a refresh operation of the display unit 10 (step S107 and step S108). To be more specific, the refresh operation is executed by the following procedures. The refresh control unit 220 resets the accumulated number of update pixels which is calculated in the calculation unit 210 to be "0" (step S107). Subsequently, it is preferable that the controller 2 drive each of the plurality of pixels 20 on the display unit 10 to display the same gradation (for example, white or black) based on the control by the refresh control unit 220 (step S108). In this case, a cancellation screen typically with the entire white or black display is displayed on the display unit 10.

On the other hand, if the accumulated number of update pixels does not reach to the defined value (step S106; No), the refresh control unit 220 drives pixels displaying the character portions Ra and Rb to partially rewrite data on the pixels and change the display states thereof (step S109). As a result, a part of the image P1 before changed is changed and the image P1 before changed is rewritten to the image P2 after changed on the display unit 10. It is to be noted that if the accumulated number of update pixels is equal to or more than the defined value (step S106; Yes), the above-described refresh operation is performed after the image P2 after changed is displayed by the partial rewriting in the same manner as the above operation.

According to the embodiment, image disturbance caused due to accumulation of afterimages by partial rewritings or the like can be prevented from being significantly caused on the display unit 10. As is already described, the refresh operation is performed by the judgment whether the accumulated number of update pixels is equal to or more than the defined value regardless of a predetermined period of time or a predetermined number of times of rewritings. Therefore, in a case where a display content is largely changed and the number of pixels of which display state is changed becomes a relatively large value, the refresh operation can be also executed in a relatively short time after the partial rewriting has been performed. Accordingly, a disturbed image can be prevented from being visually recognized by a user for a relatively long period of time.

In the embodiment, frequency of the refresh operation is defined by the defined value in the refresh control unit 220. Therefore, the refresh operation can be performed appropriately depending on the degree of image disturbance caused due to the partial rewritings. Accordingly, a trouble that a cancellation screen with entire white or black display is visually recognized by a user frequently can be suppressed and the refresh operation is performed with slight partial image disturbance.

It is to be noted that the refresh control unit 220 may execute the refresh operation every time a predetermined period of time passes or every time the partial rewriting is performed a predetermined number of times. Therefore, image disturbance on the display unit 10 can be reliably prevented from being caused.

Accordingly, according to the above-described first embodiment, the refresh operation can be appropriately performed as described above, the image quality can be improved and the convenience for a user can be improved.

Second Embodiment

Next, a second embodiment is described with reference to FIG. 5 and FIG. 6. In the second embodiment, a series of processing to the refresh operation at the time of the partial rewriting are partially different from those in the first embodiment. Hereinafter, only contents which are different from the first embodiment are described and overlapped description for the same contents as the first embodiment is not repeated in some cases.

Figure 5:
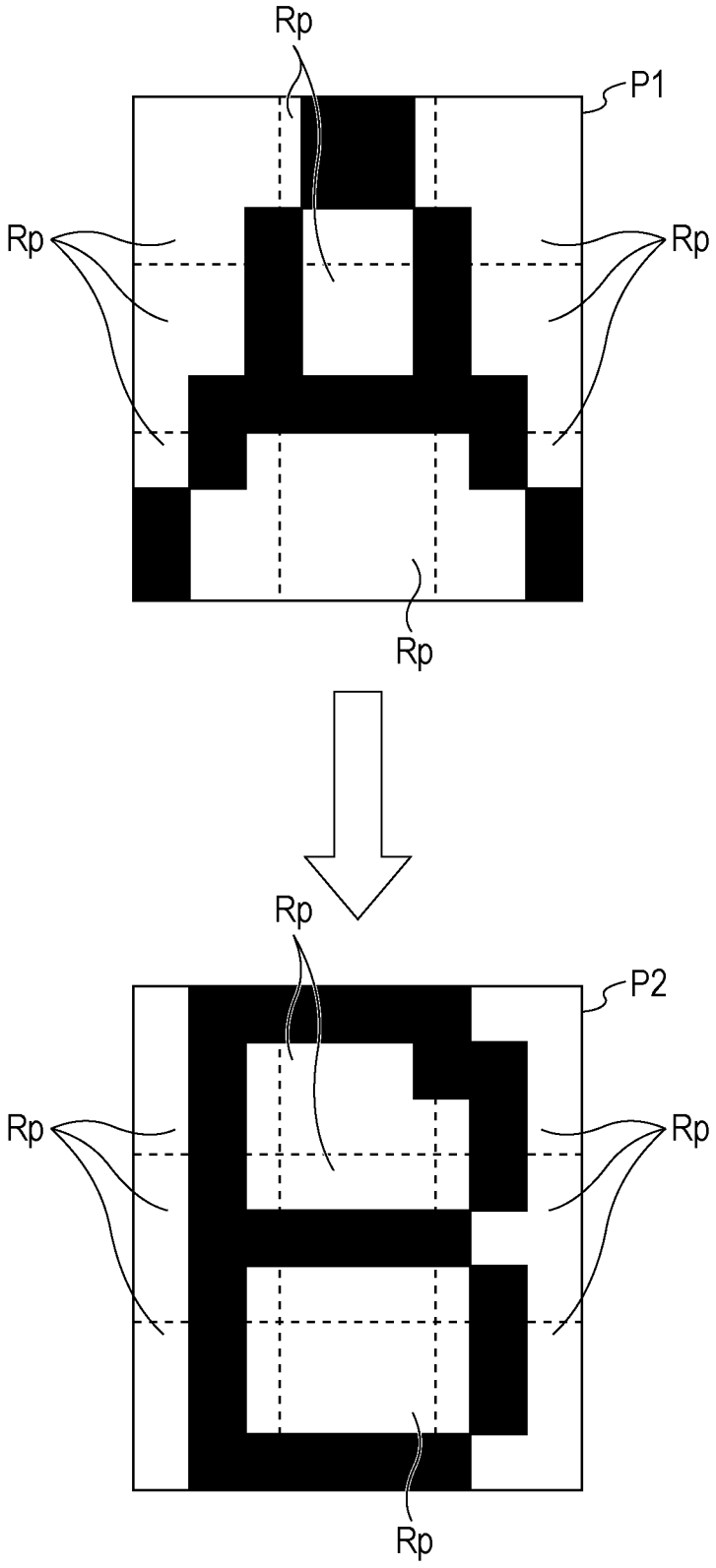
FIG. 5 is a schematic view for explaining a plurality of partial regions formed by dividing a display unit.

FIG. 5 is a schematic view for explaining a plurality of partial regions formed by dividing a display unit. FIG. 6 is a flowchart for explaining a series of processing performed in a display device according to the second embodiment.

In the second embodiment, in FIG. 5, the display unit 10 is divided into a plurality of partial regions Rp and the image P1 before changed is rewritten to the image P2 after changed in the same manner as illustrated in FIG. 2. Each of the image P1 before changed and the image P2 after changed is formed with each display on each of the plurality of partial regions Rp formed by dividing the display unit 10.

Figure 6:
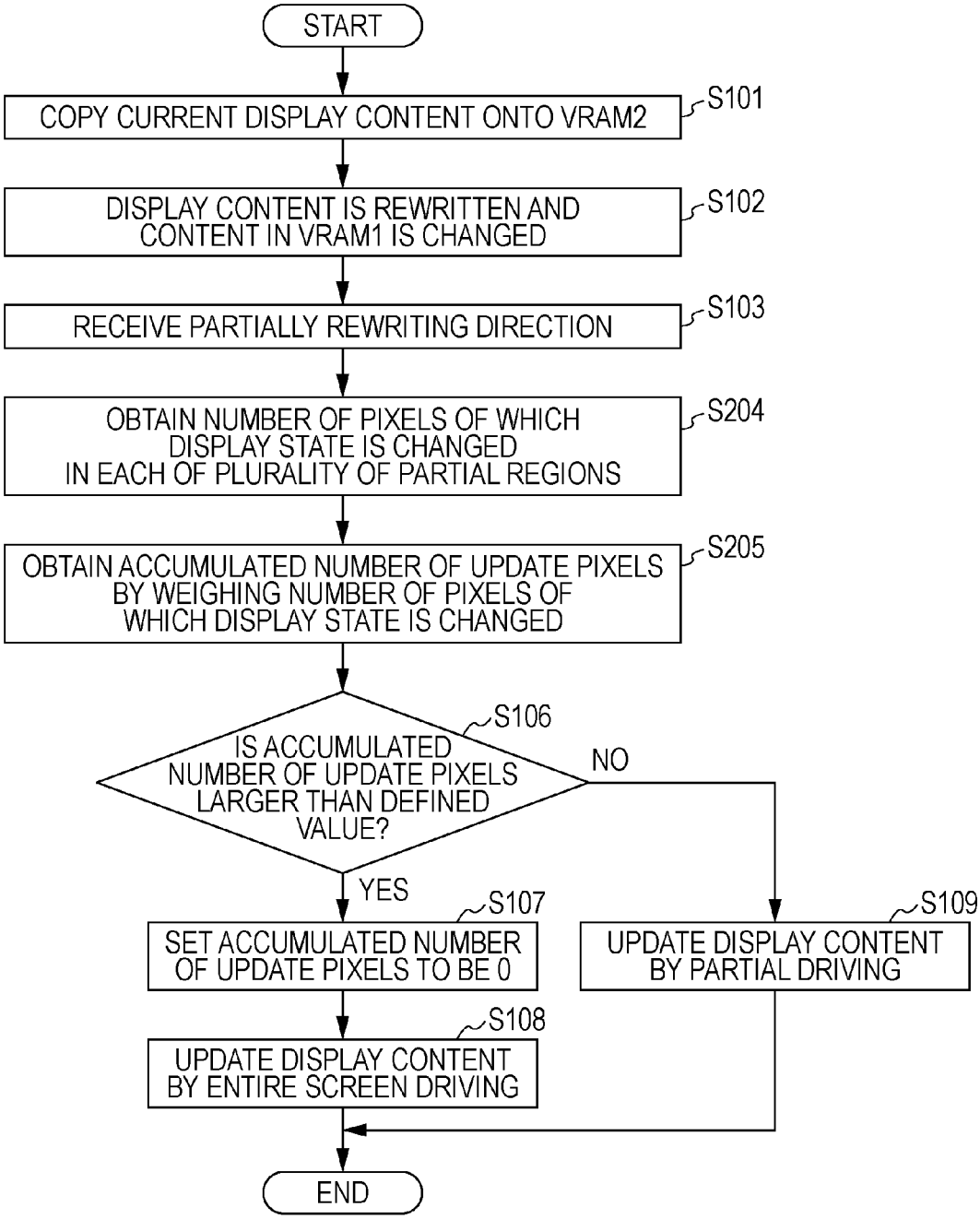
FIG. 6 is a flowchart for explaining a series of processing performed in a display device according to a second embodiment.

In the flowchart as illustrated in FIG. 6, the processing is partially different from those in the first embodiment described with reference to FIG. 3. Accordingly, only processing which is different from the first embodiment is described in detail with reference to FIG. 6, the same reference numerals denote the same processing and overlapped description is not repeated or simplified below.

In FIG. 6, after processing of step S101 through step S103, the calculation unit 210 obtains the number of pixels of which display state is changed by the partial rewriting (in the following equation (1), "number of pixels of which current display state is changed") for each of the partial regions Rp (step S204). For each of the partial regions Rp, the number of pixels of which display state is changed is obtained with the same procedures as those in the first embodiment.

Subsequently, the calculation unit 210 calculates the accumulated number of update pixels for each of the partial regions Rp (step S205). The calculation unit 210 weighs and accumulates the number of pixels of which display state is changed (following equation (1)), which has been obtained in step S204, so as to calculate the accumulated number of update pixels. At this time, the calculation unit 210 weighs the number of pixels of which display state is changed in accordance with the number of times that the display state has been changed by partial rewritings, that is, the number of times of partial rewritings ("number of times of rewritings in the corresponding region" in the following equation (1)) since the refresh operations which is previous to the current refresh operation performed after the image P2 after changed is displayed has been performed.

[Accumulated number of update pixels]=[total number of pixels of which display state has been ever changed]+([number of times of rewritings in the corresponding region]+1)×[number of pixels of which current display state is changed] (1)

It is to be noted that as in the first embodiment, the number of pixels of which display state is changed by the partial rewriting before the image P2 after changed is displayed since the previous refresh operation has been performed is obtained for each of the partial regions Rp by the calculation unit 210.

The number of pixels is weighed and accumulated in the same manner as described above so that the "total number of pixels of which display state has been ever changed" in the above equation (1) is calculated.

Thereafter, the refresh control unit 220 judges whether the accumulated number of update pixels which has been calculated for each of the partial regions Rp is equal to or more than the defined value (step S106). Then, the refresh control unit 220 appropriately executes the refresh operation (step S106; Yes, step S107 and step S108) or rewriting of changing the image P1 before changed to the image P2 after changed (step S106; No, step S109).

There is a risk that image disturbance is accumulated and becomes significant on pixels located in a partial region on which partial rewriting is repeatedly performed and the number of times of partial rewritings is relatively large among the plurality of partial regions Rp. In the second embodiment, weight in accordance with the number of times of partial rewritings becomes relatively large in such partial region. Therefore, the accumulated number of update pixels reaches to the defined value and the refresh operation can be performed before image disturbance becomes significant and more deteriorated.

Each of the plurality of partial regions Rp may be formed so as to correspond to one pixel 20. When the plurality of partial regions Rp are formed in such a manner, each of the plurality of partial regions Rp corresponds to each region which each of the plurality of pixels 20 occupies on the display unit 10. Accordingly, the refresh operation can be performed on pixels on which partial rewriting is repeatedly performed and the number of times of partial rewritings is relatively large among the plurality of pixels 20 before image disturbance is more deteriorated.

According to the above-described second embodiment, the refresh operation can be appropriately performed as described above so that image quality can be improved more reliably.

Third Embodiment

Next, a third embodiment is described with reference to FIG. 7. In the third embodiment, a series of processing to the refresh operation at the time of the partial rewriting are partially different from those in the second embodiment. Hereinafter, only contents which are different from those in the first and second embodiments are described and overlapped description for the same contents as the first and second embodiments is not repeated in some case.

In the third embodiment, as illustrated in FIG. 5, the display unit 10 is divided into a plurality of partial regions Rp and the image P1 before changed is rewritten to the image P2 after changed as in the second embodiment.

Figure 7:
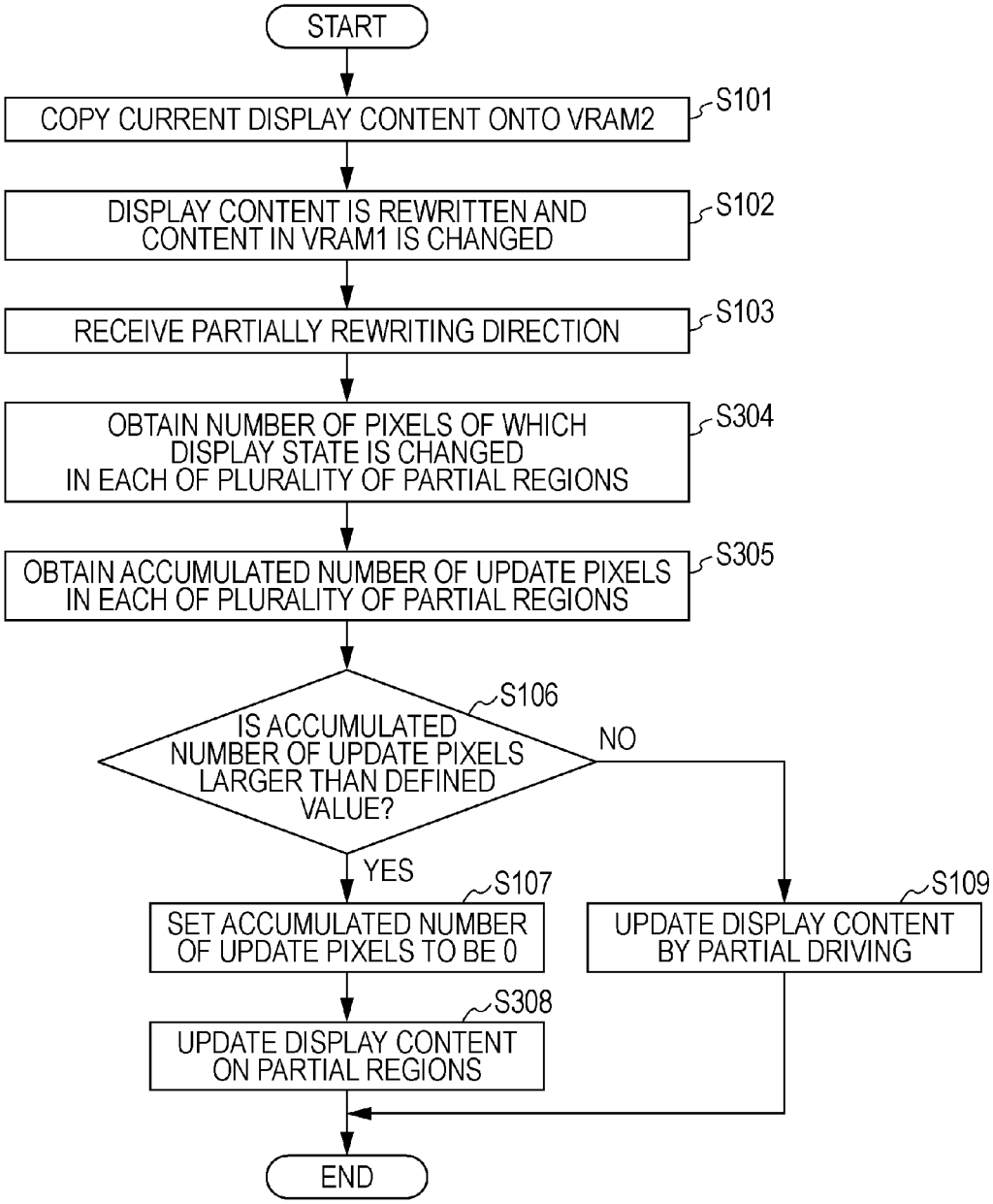
FIG. 7 is a flowchart for explaining a series of processing performed in a display device according to a third embodiment.

FIG. 7 is a flowchart for explaining a series of processing performed in a display device according to a third embodiment. Hereinafter, only processing which is different from those in the first and second embodiments are described in detail with reference to FIG. 7, the same reference numerals denote the same processing and overlapped description is not repeated or simplified.

In FIG. 7, after processing of step S101 through step S103, the calculation unit 210 obtains the number of pixels of which display state is changed by partial rewriting for each of partial regions Rp (step S304). Subsequently, the calculation unit 210 accumulates the number of pixels of which display state is changed, which has been obtained in step S304, so as to calculate the accumulated number of update pixels for each of the partial regions Rp (step S305). In the third embodiment, for each of the partial regions Rp, the number of pixels of which display state is changed is obtained so that the accumulated number of update pixels is calculated with the same procedures as those in the first embodiment.

Thereafter, the refresh control unit 220 judges whether the accumulated number of update pixels calculated for each of the partial regions Rp is equal to or more than a defined value (step S106). Then, the refresh control unit 220 appropriately executes the refresh operation (step S106; Yes, step S107 and step S308) or rewriting of changing the image P1 before changed to the image P2 after changed (step S106; No, step S109).

In this case, in step S107 and step S308, it is preferable that the refresh operation be partially performed on a partial region Rp on which the accumulated number of update pixels reaches to a defined value. At this time, in step S308, each pixel 20 in the partial regions Rp is driven to display the same gradation (for example, white or black). It is to be noted that with such partial refresh operation, since frequency of the refresh operation is different between the partial regions Rp, difference in quality of displayed image such as contrast may be caused. Accordingly, in order to prevent such a problem from being caused, the refresh operation may be performed on the entire screen typically with the entire white or black display.

Therefore, in the third embodiment, the accumulated number of update pixels is obtained for each of the partial regions Rp so that the above-described partial refresh operation is performed, thereby smoothly performing a refresh operation for a short period of time. This makes it possible to reduce the use's irritation and improve the convenience.

The invention is not limited to the above embodiments and can be appropriately modified without departing from the scope or spirit of the invention within a range which can be read from aspects of the invention and the entire specification. Further, a display device including such modifications is also encompassed in a technical range of the invention.

The entire disclosure of Japanese Patent Application No. 2010-020509, filed Feb. 1, 2010 is expressly incorporated by reference herein.

What is claimed is:

1. A display device comprising: a display unit that has a plurality of pixels displaying a first image and a second image, the second image being displayed after the first image is changed, each of the plurality of pixels having a first state and a second state; a calculation unit that calculates a different state number of the plurality of pixels between the first image and the second image; and a refresh control unit that executes a refresh operation of the display unit, wherein the different state number is calculated by comparing each of the plurality of pixels of the first image and each corresponding pixel of the second image and counting a number of pixels that switched from one of the first or second states to the other of the first or second states, and the refresh control unit executes the refresh operation to the plurality of pixels when the different state number is equal to or more than a predetermined number, a plurality of regions that are defined by dividing the display unit, wherein the calculation unit weights the different state number in the each of the plurality of regions in accordance with a number of times an image displayed on the display unit changes since a previous refresh operation so as to calculate a total number of the different state number.

2. The display device according to claim 1, wherein each of the plurality of regions corresponds to each of the plurality of pixels.

3. The display device according to claim 1, further comprising:

a plurality of regions that are defined by dividing the display unit, wherein the calculation unit calculates the different state number of each of the plurality of regions.

4. The display device according to claim 1, wherein the refresh control unit executes the refresh operation every time a predetermined period of time passes or in accordance with a predetermined change number of times of changing an image displaying on one of a plurality of regions that are defined by dividing the display unit.

5. A controller for a display device including a display unit having a plurality of pixels displaying a first image and a second image that is displayed after the first image is changed, each of the plurality of pixels having a first state and a second state, the controller comprising: a calculation unit that calculates a different state number of the plurality of pixels between the first image and the second image; and a refresh control unit that executes a refresh operation of the display unit, wherein the different state number is calculated by comparing each of the plurality of pixels of the first image and each corresponding pixel of the second image and counting a number of pixels that switched from one of the first or second states to the other of the first or second states, and the refresh control unit executes the refresh operation to the plurality of pixels when the different state number is equal to or more than a predetermined number, a plurality of regions that are defined by dividing the display unit, wherein the calculation unit weights the different state number in the each of the plurality of regions in accordance with a number of times an image displayed on the display unit changes since a previous refresh operation so as to calculate a total number of the different state number.

6. The controller according to claim 5, wherein each of the plurality of regions corresponds to each of the plurality of pixels.

7. The controller according to claim 5, further comprising:

a plurality of regions that are defined by dividing the display unit, wherein the calculation unit calculates the different state number of each of the plurality of regions.

8. The controller according to claim 5, wherein the refresh control unit executes the refresh operation every time a predetermined period of time passes or in accordance with a predetermined change number of times of changing an image displaying on one of a plurality of regions that are defined by dividing the display unit.

* * * * *